US006793214B2

(12) United States Patent
Loose et al.

(10) Patent No.: US 6,793,214 B2
(45) Date of Patent: Sep. 21, 2004

(54) DEVICE FOR SUBDIVIDING STACKS

(75) Inventors: Jochen Loose, Irving, TX (US); Armin Zimmermann, Constance (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/360,660

(22) Filed: Feb. 10, 2003

(65) Prior Publication Data

US 2003/0168797 A1 Sep. 11, 2003

Related U.S. Application Data

(63) Continuation of application No. PCT/DE01/03024, filed on Aug. 15, 2001.

(30) Foreign Application Priority Data

Aug. 17, 2000 (DE) ..... 100 40 229
Aug. 15, 2001 (EP) ..... 01962614

(51) Int. Cl.[7] ..... B65H 1/02
(52) U.S. Cl. ..... 271/149; 414/798.9
(58) Field of Search ..... 271/149; 414/798.9

(56) References Cited

U.S. PATENT DOCUMENTS 1,442,997 A * 1/1923 Biver et al. ..... 271/171
3,586,313 A * 6/1971 Ebeling ..... 271/10.02
3,931,880 A * 1/1976 Ayer ..... 198/382
3,986,614 A * 10/1976 Fernandez-Rana et al. ... 211/51
4,429,864 A * 2/1984 Scarpa et al. ..... 271/10.1
4,523,753 A * 6/1985 Hiromori et al. ..... 271/31.1
4,826,019 A * 5/1989 Kondo et al. ..... 209/538
4,974,826 A * 12/1990 Svyatsky et al. ..... 271/179
5,044,877 A * 9/1991 Constant et al. ..... 414/798.9
5,100,022 A * 3/1992 Fukudome et al. ..... 221/198
5,398,931 A * 3/1995 Tohgoh ..... 271/126
5,957,448 A * 9/1999 Frank et al. ..... 271/152
5,993,132 A * 11/1999 Harres et al. ..... 414/416.04

* cited by examiner

*Primary Examiner*—Douglas Hess
(74) *Attorney, Agent, or Firm*—Jacob Eisenberg; Siemens AG

(57) ABSTRACT

The present invention relates to an apparatus for dividing a stack of items. The items may comprise mail pieces. The apparatus comprises at least one supporting finger which extends through an opening within a base. The base supports the items which stand thereon and further lean against a supporting wall. Where more than one supporting finger is present, the finger may further comprise a hollow opening and/or groove which accommodates the other supporting fingers therein. Accordingly, as all of the supporting fingers pass through the opening, the size of the opening is reduced. In addition, the supporting fingers may be specially sized so as to accommodate different sized items. The supporting fingers are arced so that when they are extended through the opening, they arc towards the base. The height achieved by a supporting finger is related to the height of the item being engaged by the finger. A drive mechanism drives the finger(s) through the opening, the drive mechanism may include a rotary arm(s) associated with each finger and a further drive and/or control element to effect pivoting of the arms thereby urging the fingers through the opening.

17 Claims, 6 Drawing Sheets

DEVICE FOR SUBDIVIDING STACKS

CONTINUATION DATA

The present invention is a continuation of and claims priority to international application: PCT/DE01/03024, filed Aug. 15, 2001, and further claims priority to German patent application 10040229.1, filed Aug. 17, 2000 and European patent application 01962614.2, filed Aug. 15, 2001, all of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to an apparatus for dividing or subdividing stacks of narrow items, such as mail pieces, which are standing on a base and leaning against a supporting wall.

The division of bigger stacks into subdivisions of any size, where the shape of the stack is maintained, permits automatic further processing of the stack sections. Oftentimes, the stack division is performed manually with a swiveling or rotating in of one or more separation knives.

Known automatic means may also be employed. One such means occurs where the lower edge of a compact stack of mail pieces is spread by producing a gap, with different speeds, at defined places, by conveying belts. Then several teeth of a rake type apparatus emerge from below, enter the stack of mail pieces, and extend vertically upwards. A problem exists with this method, namely, with the immersion of several teeth arranged in a row supporting large-surface mail pieces, one or more mail pieces can get caught between the teeth, so that these mail piece(s) get jammed. The mail pieces can therefore not be allocated to a select stack division and often lead to a jam. The cause for this lies mostly with mail pieces which were sorted one-sided and/or mail pieces which are not parallel to the teeth. Furthermore, the teeth can move the mail pieces out of their aligned position, which causes problems during subsequent processing. Accordingly, a need exists to address the above discussed difficulties.

SUMMARY OF THE INVENTION

The present invention is generally directed to an apparatus for the division of stacks. The stacks may comprise relatively narrow mail pieces which stand upright and lean against a supporting wall, where obstructions, due to mail piece jams and/or dislocations, are reduced in comparison with the current state of the art. The application, according to the invention, of only one circularly bent supporting finger directed towards the supporting wall (the finger movable upwards through an opening in the base) prevents a jamming of unevenly placed mail pieces. Via the bend towards the supporting wall and during the run-up of the supporting finger, an orientation or urging of the engaged mail pieces also occurs in cooperatively with the friction force component of the supporting wall. The bent supporting finger may comprise a plurality of interlaced fingers. The direction of their bend or arc may be towards and/or away from the supporting wall.

If the bend radius and the length of the circular arc segment are chosen in such a way that the end of the supporting finger exhibits a component of motion directed at the base at the moment of the impact on the supporting wall, then the touched mail pieces are additionally orientated towards the base by the respective friction force component. A possible run-up of the touched mail pieces can thereby be compensated at the beginning of the extending motion of the supporting finger. Accordingly, it is advantageous to effect the bend radius of the supporting finger to be smaller than the height of the smallest mail piece.

If the mail pieces of the stack comprise substantially different sizes, i.e. if for example mail pieces double in size need to be supported, it is advantageous to push upwards an additional circularly bent or arcing supporting finger through the opening in the base. It is advantageous to only push upwards the additional supporting fingers when the first supporting finger is completely extended and the mail pieces which were touched by it are fixed. A dislocation of the mail pieces during the run-up of the additional supporting fingers is thereby prevented. The bend radius of the additional supporting fingers is advantageously greater than or equal to the height of the biggest mail piece. The bending or urging of the additional supporting fingers can thereby be directed towards the supporting wall as well as away from it, so that the large mail pieces are safely supported over their entire surface.

To keep the opening in the base as small as possible, the supporting finger for the smallest mail piece and optionally the additional supporting fingers comprise open hollow sections or grooves so as to accommodate or interlace other supporting fingers therein.

For a realization of finger urging, each bent supporting finger is advantageously and connected to a rotary arm arranged below the base. The arm pivots about a point such that an upward motion of the arm portion connected the supporting finger imparts upward force on the particular finger, thereby urging it through the opening. The arm or rotary arm may swivel by a controlled rotary drive. In an additional advantageous embodiment of actuation, the supporting fingers are piloted and driven in a bent guide piece. The actuation can be realized in a way and manner known in the art, for example by wheel and disk drive, rack gear, linear motor, and the like.

The above and other advantages are facilitated by an apparatus for dividing a stack of items resting on a base and standing upright against a supporting wall, comprising: walls within said base defining an opening; at least one supporting finger for dividing said stack, said at least one finger having an arc shape in a direction of said supporting wall and positioned within said opening; a drive mechanism functionally associated with said at least one finger so as to urge said at least one finger through said opening and engage said stack; and a distance between said opening and supporting wall set so as not to be greater than a length of a smallest item in said stack.

It is also advantageous to implement the supporting fingers so that they converge narrow towards their ends. Accordingly, it is now possible to do away with additional means for the spreading of the stack before the use of the supporting fingers. Other features and advantages of the present invention will become evident from the specification and claims below.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
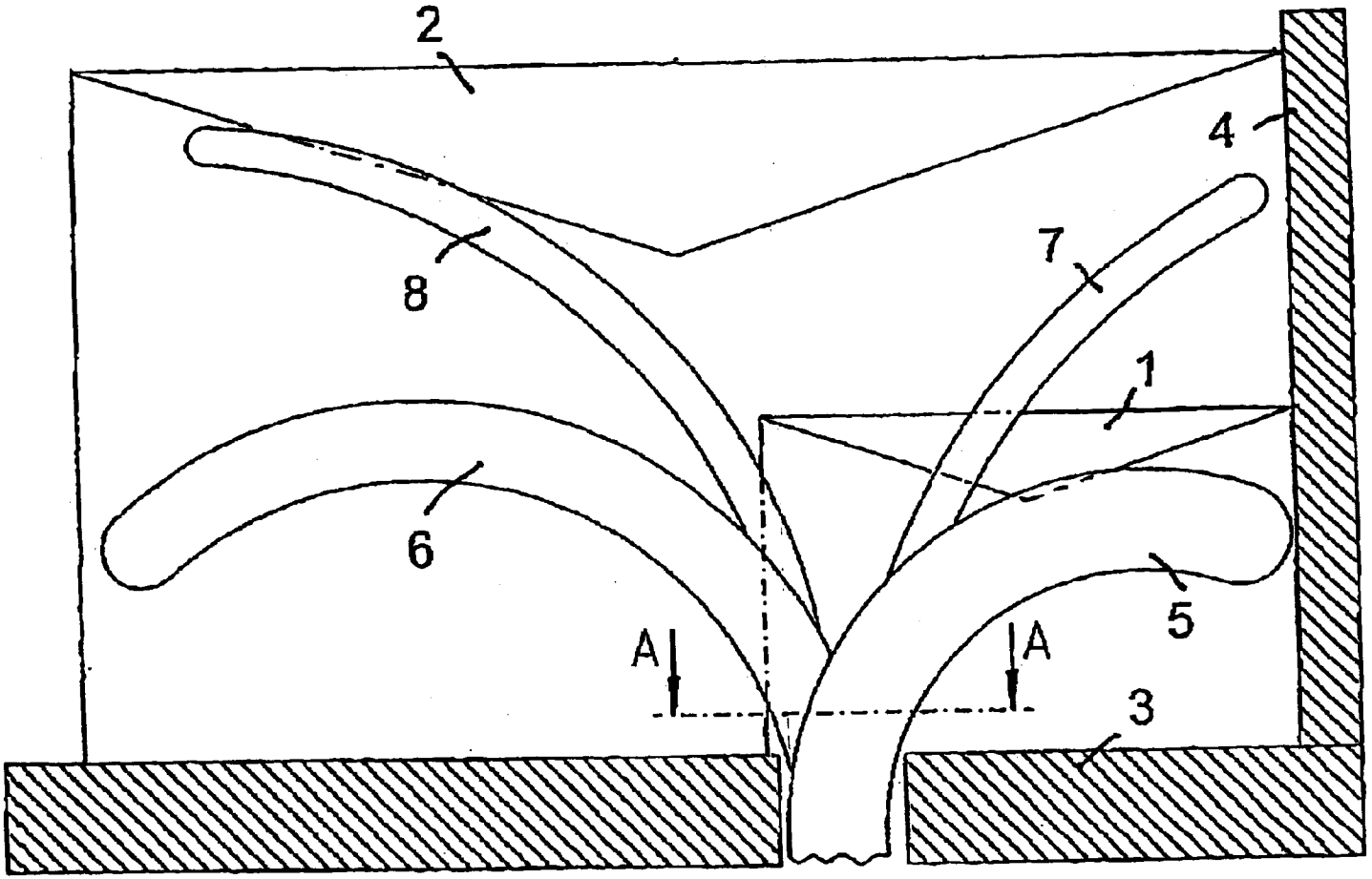
FIG. 1 depicts a sectional view of a partitioned stack with supporting fingers extended.
Figure 2:
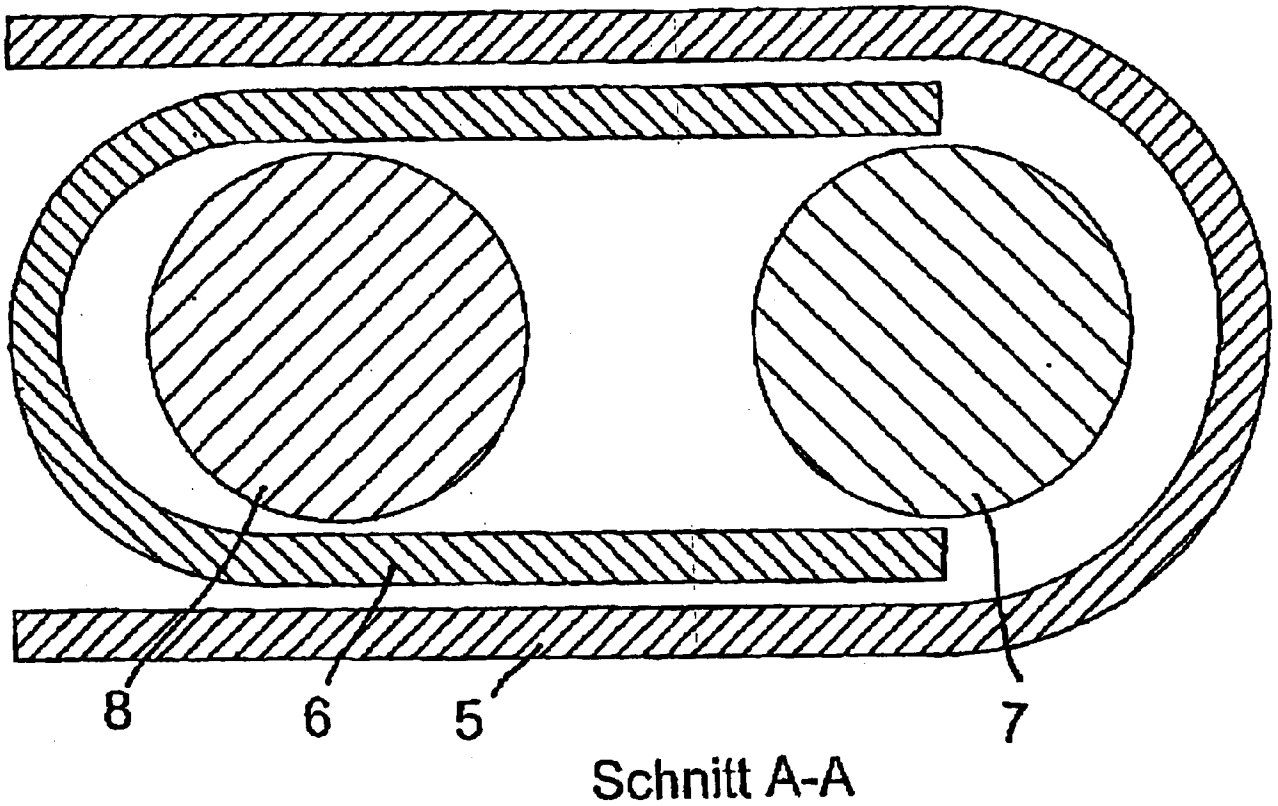
FIG. 2 depicts a disclosure of cross section A—A of FIG. 1.

FIG. 1 depicts a sectional view of a stack of mail pieces standing on a base 3. Front exposed mail pieces 1 and 2 are depicted leaning against supporting wall 4. The orientation of the mail pieces in the stack may not necessarily be as ideal as what is depicted for the front mail pieces. The supporting fingers 5–8 are depicted in a fully extended position. Base 3 further comprises walls defining an opening or hole 3. In a preferred embodiment, the hole is made to be as small as practical while still accommodating supporting fingers 5–8 therethrough.

As would be appreciated by one skilled in the art, the number of fingers is a design choice dependent upon application, and vision of one skilled in the art. For illustration purposes, four supporting fingers are depicted and discussed-herein. Supporting-finger 5 is bent in an arc towards supporting wall 4. The supporting finger 5 has a bend which defines an arc no larger than the dimensions of a smallest anticipated mail piece. The mail piece dimensions may include mail piece height and/or length, such that a supporting finger does not overshadow the mail piece (as depicted mail piece 1). As depicted, the supporting finger 5 is bent slightly downwards. Finger 5 further comprises a U shaped groove, channel, or hollow opening, depicted as being open and facing the left hand side of the figure. Therein, other supporting fingers 6–8 are accommodated, some with openings of their own. Clearly, the inner most fingers do not require openings as no additional fingers are present and require accommodation.

The shape of supporting finger 6 comprises an arc directed in another, and preferably opposite, direction to finger 5. Finger 6 further comprises a size which, when fully extended does not rise above an approximate mid point of mail piece 2. In addition, a front end, in the extending direction, bends downward towards supporting base 3. Like finger 5, finger 6 also includes a U shaped channel or groove for accommodating other supporting fingers therein. Given that finger 5 is accommodated within finger 6, the groove of finger 6 is smaller than that of finger 5. In addition, the groove of finger 6 faces within the groove of finger 5. In FIG. 1, this would be towards the right of the figure. Accordingly, the two supporting fingers 5 and 6 do not obstruct each other during the extension and are freely moveable with respect to one another. Alternatively, an "outer" accommodating finger would need to be fully extended prior to extension of an "inner" accommodated finger. The two supporting fingers 7 and 8, directed towards the upper corners of the large mail piece 2, may move in parallel within the two channels. Because there are no additional supporting fingers, and fingers 7 and 8 are relatively parallel, no open profiles or groove within fingers 7 and 8 are necessary. Of course, in other embodiments, the number of supporting fingers supporting other fingers within grooves is limited only by design.

At least the supporting fingers 5 and 6, with inwardly facing openings, should preferably converge as narrowly as possible, for an easy upward movement of the supporting fingers between two mail pieces of the stack without elevating the mail piece. This results in each supporting finger needing first to be extended upward, almost in its entirety, before the inner supporting finger may follow, so as to prevent a clamping of the inner supporting finger with the outer supporting finger which converges narrow on the outside.

Different time frames of supporting finger extension are depicted in FIGS. 3*a–d*. The supporting fingers are shown dividing a mail piece stack into sections. The arcing supporting fingers 5–8 are firmly and individually connected to individual rotary arms 10 which effect a pivoting motion and are located below base 3. The rotation of rotary arms 10 are effected by controlled rotary drives 11. Because, in this embodiment, the supporting fingers 5 and 6 do not include U shaped channels, the supporting fingers 5–8 need to be pushed in relatively parallel through hole or opening 9 in the base 3. Therefore, the opening 9 has to be dimensioned accordingly. This faces the advantage that the supporting fingers can be run up independently from each other at any time. The rotary arms 10 are put into motion by the rotary drives 11 thereby causing an upwardly directed urging of the supporting fingers through opening 9.

Figure 3A:
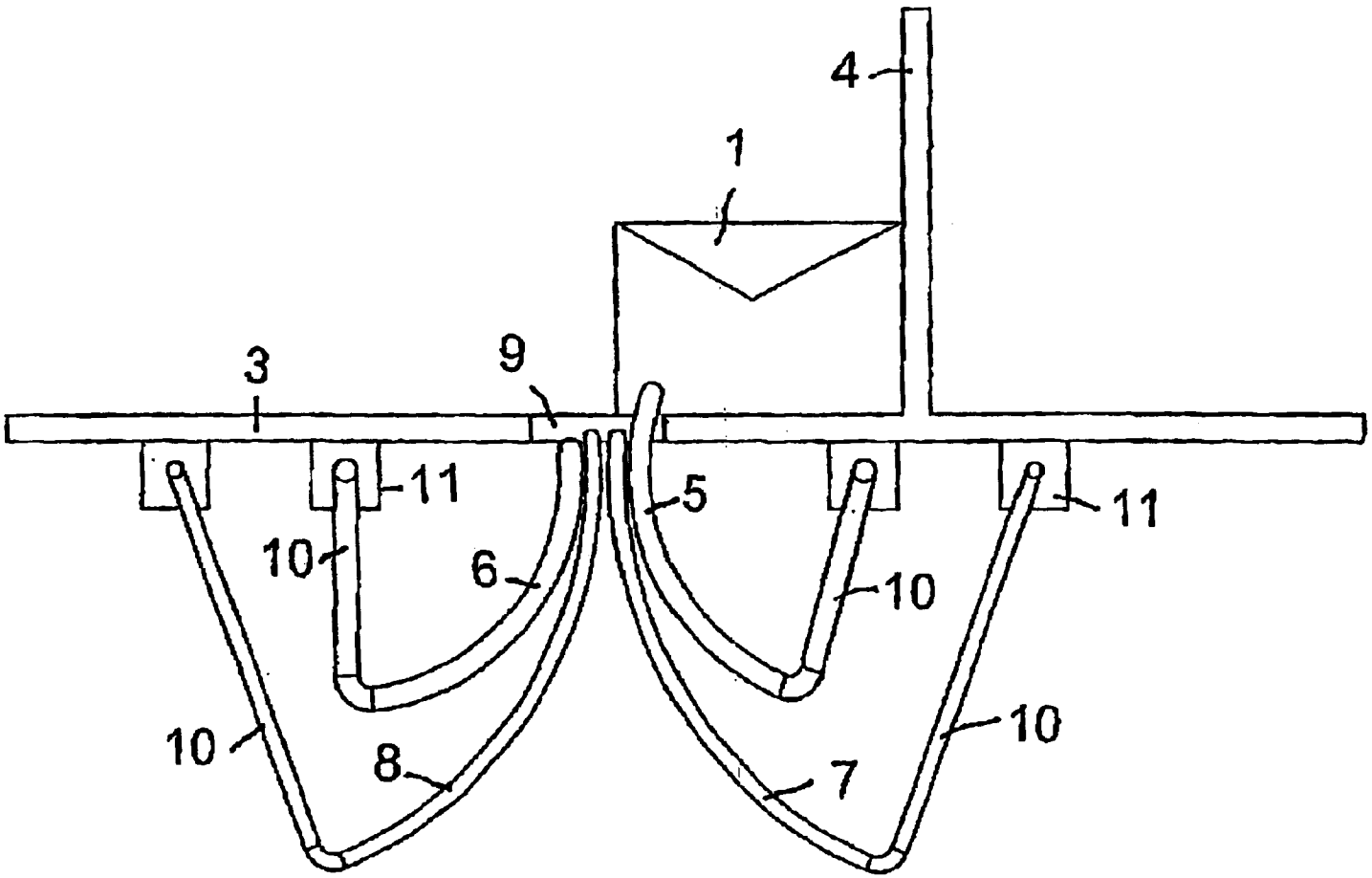
FIGS. 3*a–d* depict a different time points during use of the supporting fingers.
Figure 3B:
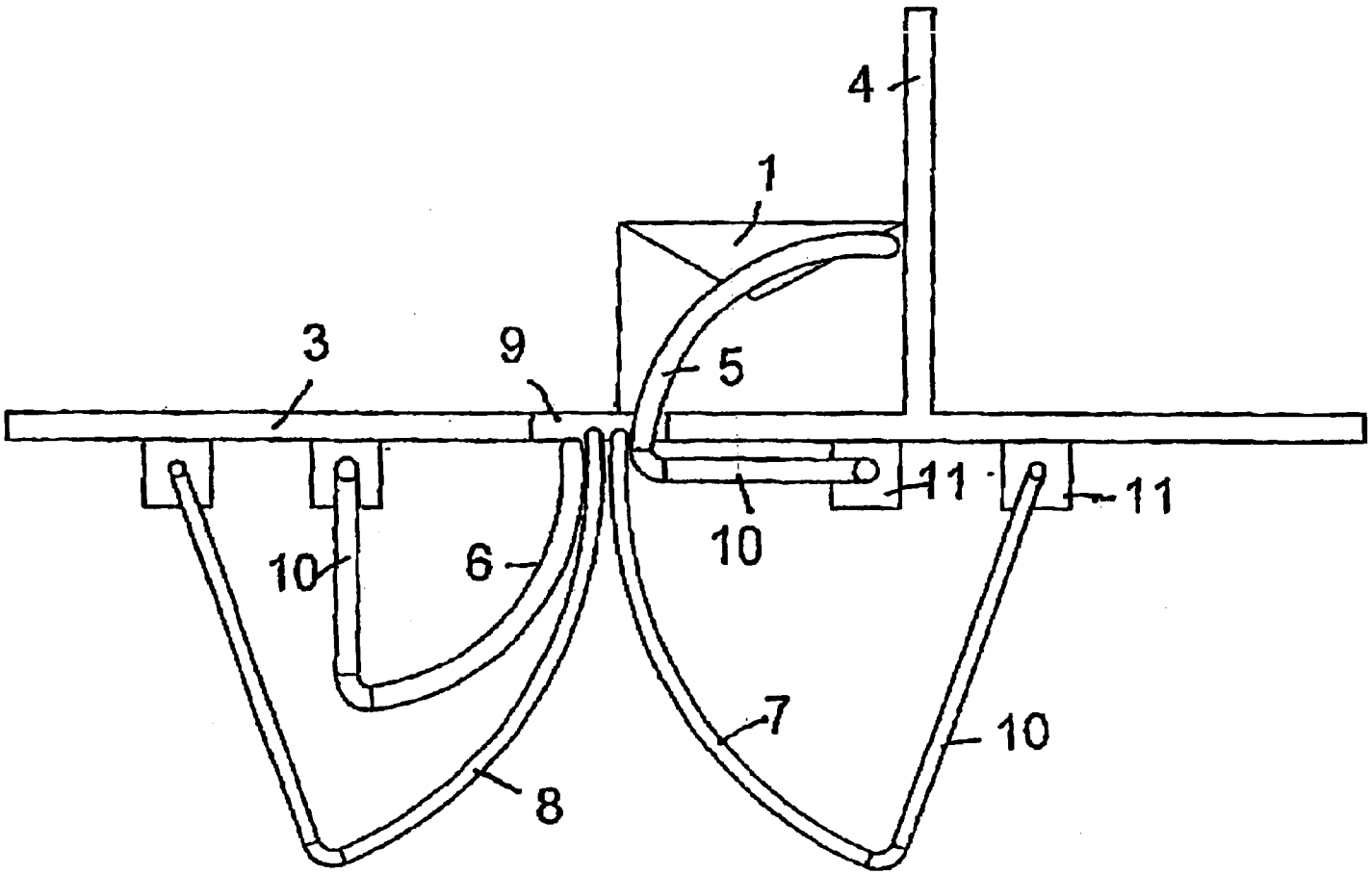
Figure 3C:
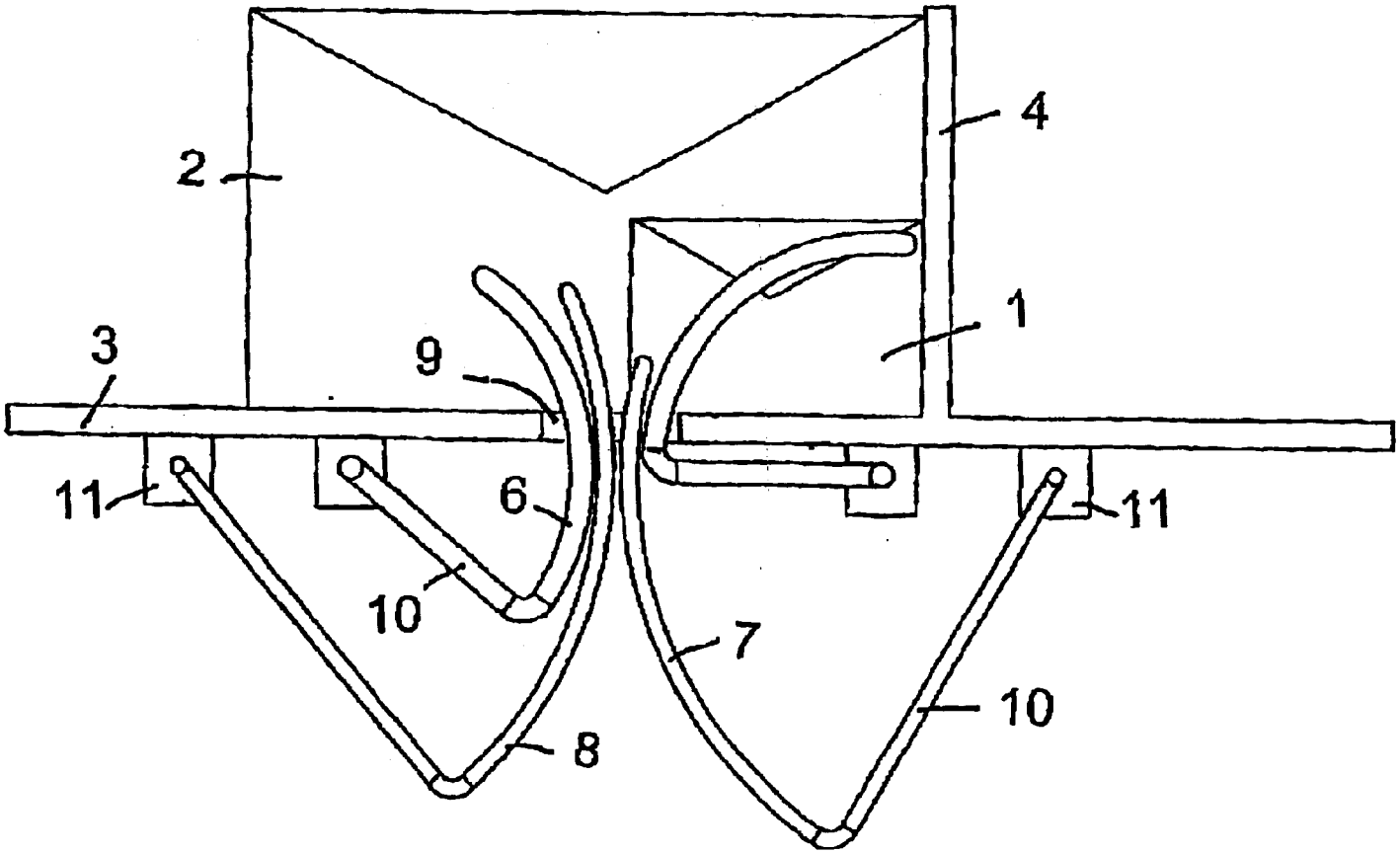
Figure 3D:
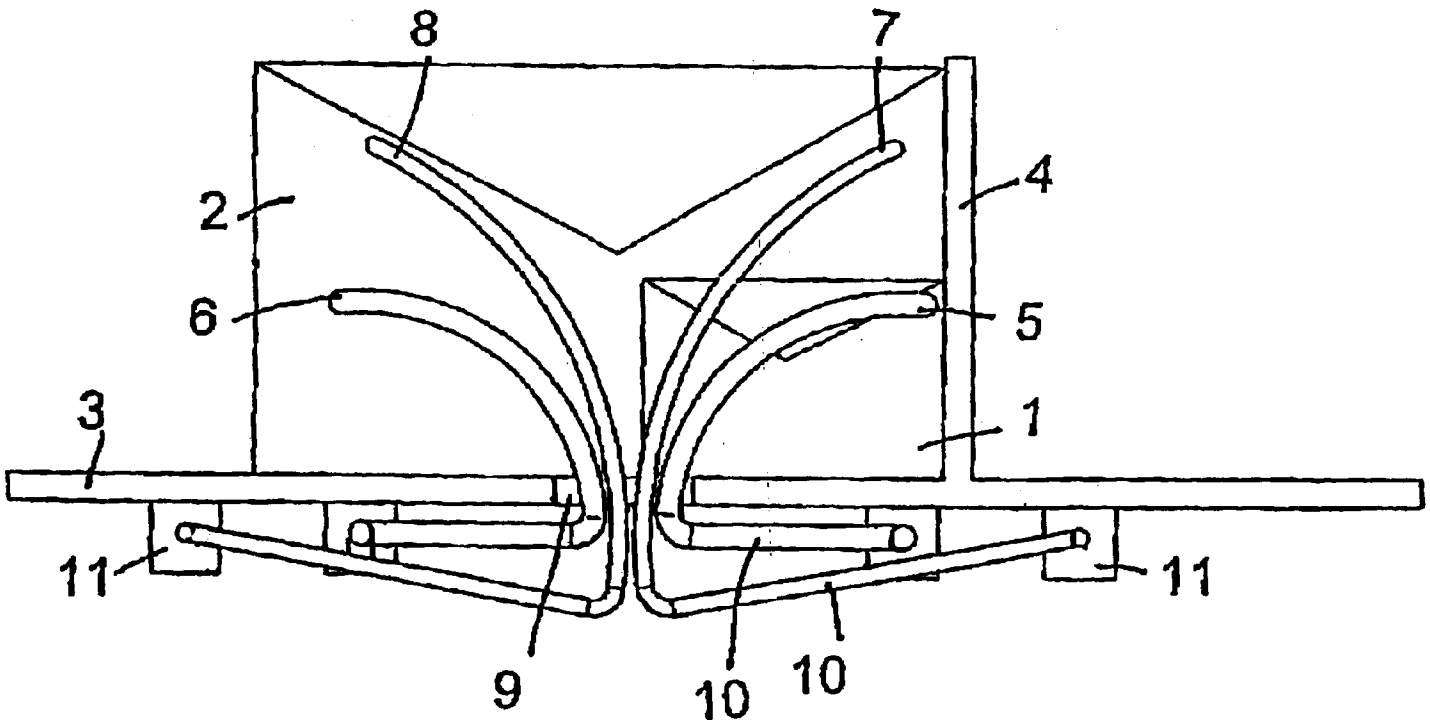

The upward movement of the supporting fingers for the smallest mail piece 1 starts in FIG. 3*a* and is completed in FIG. 3*b*. The respective rotary arm 10 runs almost parallel to the base 3 and the tip of the supporting finger 5 touches the supporting wall 4. If the stack only comprises smaller mail pieces (e.g. piece 1), the division of the stack is then effectively completed. If, however, the stack further comprises small and large mail pieces (e.g. 1 and 2), then it is necessary to deploy additional supporting fingers. Namely, the additional fingers are pushed upwards to stop the large mail pieces 2, which in this example would comprise a piece of mail in the next stack. An almost parallel run-up of the remaining supporting fingers 6–8 is depicted in FIG. 3*c*. This is possible, because the section of the stack was already fixed by the supporting finger 5. The implementing of the additional supporting fingers is completed in FIG. 3*d* with the section of the stack now safely supported by all of the fingers.

Alternative embodiment language, includes. Application to the partition of a stack of any type of partitionable item having, preferably, but not necessarily, a flat flexible shape. Accordingly, the present invention may be applied outside the mail stacking arts, or in particular, outside specific application to mail pieces, as envisioned by one skilled in the art.

What is claimed is:

1. An apparatus for dividing a stack of items resting on a base and standing upright against a supporting wall, comprising:

walls within said base defining an opening;

at least one supporting finger for dividing said stack, said at least one finger having an arc shape in a direction of said supporting wall and positioned within said opening;

a drive mechanism functionally associated with said at least one finger so as to urge said at least one finger through said opening in a non perpendicular upward direction and engage said stack; and a distance between said opening and supporting wall set so as not to be greater than a length of a smallest item in said stack.

2. The apparatus according to claim 1, wherein said at least one supporting finger comprises a plurality of supporting fingers, said plurality of fingers being interlaced.

3. The apparatus according to claim 2, wherein said plurality of supporting fingers comprise different lengths.

4. The apparatus according to claim 3, wherein said drive mechanism further comprises means for individually driving each of said plurality of supporting fingers.

5. The apparatus according to claim 4, wherein at least one of said plurality of supporting fingers comprises an arc directed away from said supporting wall.

6. The apparatus according to claim 5, wherein said interlaced fingers are effected by at least a first supporting finger comprising a groove therein, said groove accommodating at least a second supporting finger therein.

7. The apparatus according to claim 6, wherein said first finger must completely extend before another finger may extend from said opening.

8. The apparatus according to claim 1, wherein said drive mechanism engages a first end of said at least one supporting finger, said at least one supporting finger comprises an arc such that upon extension by said drive mechanism, a second end of said supporting finger extends in a direction proximate to said base.

9. The apparatus according to claim 8, wherein said at least one supporting finger converges from said first end to said second end.

10. The apparatus according to claim 1, wherein a radius of curvature of one of said at least one supporting finger is set such that a maximum height of said one of said at least one supporting finger does not extend beyond a height of said smallest item.

11. The apparatus according to claim 10, wherein a radius of curvature of another of said at least one supporting finger is set such that a maximum height of said another of said at least one supporting finger extends beyond a height of a tallest item.

12. The apparatus according to claim 1, wherein said items comprises mail items.

13. The apparatus according to claim 1, wherein a supporting finger is associated with said smallest item, and said supporting finger comprises an open hollow section, said section accommodating other supporting fingers therein.

14. The apparatus according to claim 1, wherein said drive means further comprises a number of pivoting rotary arms located below said base and controlled by a rotary drive, such that each of said arms is associated to one of said at least one supporting fingers so that when said rotary arm pivots, said associated finger is urged through said opening.

15. An apparatus for dividing a stack of items resting on a base and standing upright against a supporting wall, comprising:

walls within said base defining an opening;

a plurality of interlaced supporting fingers for dividing said stack, said fingers positioned within said opening and comprising different lengths, at least one of said fingers comprises an arc shape in a direction towards said supporting wall and another of said fingers comprises an arc shape in a direction away from said supporting wall, and at least a first of said fingers comprises a groove therein, said groove accommodating at least a second supporting finger therein;

a drive mechanism functionally associated with said fingers so as to urge at least one finger through said opening and engage said stack, said drive mechanism further comprising means for individually driving each of said plurality of supporting fingers; and a distance between said opening and supporting wall set so as not to be greater than a length of a smallest item in said stack.

16. The apparatus according to claim 15, wherein said first finger must completely extend before another finger may extend from said opening.

17. An apparatus for dividing a stack of items resting on a base and standing upright against a supporting wall, comprising:

walls within said base defining an opening such that a distance between said opening and said supporting wall is set so as not to be greater than a length of a smallest item in said stack at least two supporting fingers for dividing said stack, said at least one of said fingers having an arc shape in a direction of said supporting wall and positioned within said opening, wherein a supporting finger is associated with said smallest item, and said supporting finger comprises an open hollow section accommodating other supporting fingers therein; and a drive mechanism functionally associated with said at least two finger so as to urge said at least one of said at least two fingers through said opening and engage said stack.

* * * * *